US006459248B2

(12) United States Patent
Pohlman

(10) Patent No.: US 6,459,248 B2
(45) Date of Patent: Oct. 1, 2002

(54) MICROELECTRONIC CURRENT REGULATOR

(75) Inventor: William Pohlman, Phoenix, AZ (US)

(73) Assignee: Primarion, Inc., Tempe, AZ (US)

( * ) Notice: Subject to any disclaimer, the term of this patent is extended or adjusted under 35 U.S.C. 154(b) by 0 days.

(21) Appl. No.: 09/771,545

(22) Filed: Jan. 29, 2001

Related U.S. Application Data

(60) Provisional application No. 60/178,357, filed on Jan. 27, 2000.

(51) Int. Cl.[7] ..... G05F 1/40

(52) U.S. Cl. ..... 323/282

(58) Field of Search ..... 323/268, 270, 323/271, 273, 274, 275, 280, 282, 284, 285

(56) References Cited

U.S. PATENT DOCUMENTS

| | | | | |
|---|---|---|---|---|
| 4,228,404 A | | 10/1980 | Widlar | |
| 4,288,805 A | | 9/1981 | Depey | |
| 5,548,205 A | | 8/1996 | Monticelli | |
| 5,635,868 A | | 6/1997 | Aiello et al. | |
| 5,672,988 A | | 9/1997 | Nelson et al. | |
| 5,754,417 A | | 5/1998 | Nicollini | |
| 5,828,206 A | | 10/1998 | Hosono et al. | |
| 5,874,849 A | | 2/1999 | Marotta et al. | |
| 5,955,915 A | | 9/1999 | Edwards | |
| 6,031,364 A | * | 2/2000 | Hosono et al. | 323/280 |
| 6,249,112 B1 | * | 6/2001 | Khouri et al. | 323/282 |

FOREIGN PATENT DOCUMENTS

| | | |
|---|---|---|
| EP | 0 499 921 A2 | 2/1992 |
| EP | 0 580 921 A1 | 7/1992 |
| EP | 0 674 389 A1 | 3/1994 |
| EP | 0 751 238 A2 | 12/1995 |

* cited by examiner

*Primary Examiner*—Matthew Nguyen
(74) *Attorney, Agent, or Firm*—Snell & Wilmer L.L.P.

(57) ABSTRACT

A circuit for providing regulated power to a microelectronic device is disclosed. The circuit includes an error amplifier, a transistor, and a supplemental voltage supply coupled to the transistor. The supplemental voltage supply supplies requisite bias to operate the transistor near its saturation point.

17 Claims, 1 Drawing Sheet

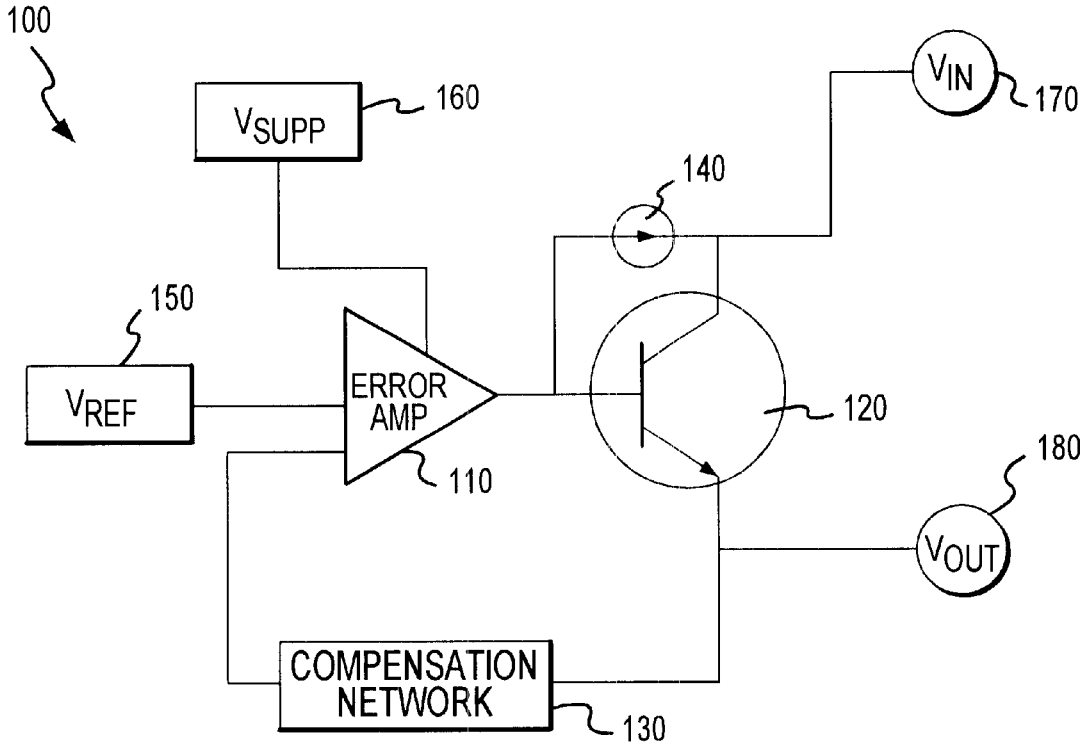
100
VSUPP
160
VIN
170
140
150
VREF
ERROR AMP
110
120
180
VOUT
COMPENSATION NETWORK
130

MICROELECTRONIC CURRENT REGULATOR

CROSS REFERENCE TO RELATED APPLICATIONS

This application claims priority to U.S. Provisional Application Serial No. 60/178,357, filed Jan. 27, 2000, entitled "Microelectronic Current Regulator."

TECHNICAL FIELD

The present invention generally relates to microelectronic integrated circuits. More particularly, the present invention relates to microelectronic power regulation circuits.

BACKGROUND OF THE INVENTION

Regulators are often employed to provide a desired, regulated power to microelectronic devices such as microprocessors. For example, switching regulators such as buck regulators are often used to step down a voltage (e.g., from about 3.3 volts) and provide suitable power to a microprocessor (e.g., about 10–30 amps at about 2–3 volts).

To increase speed and reduce costs associated with microprocessors, microprocessor gate counts and integration generally increase, while the size of the microprocessor per gate generally decreases. As gate counts, speed, and integration of microprocessors increase, supplying requisite power to microprocessors becomes increasingly problematic. For example, a current required to drive the processors generally increases as the number of processor gates increases. Moreover, as the gate count increases per surface area of a processor, the operating voltage of the processor must typically decrease to, among other reasons, reduce overall power consumption of the processor.

As microprocessor power demands increase, use of typical power regulators to control and supply requisite power becomes increasingly problematic. For example, the regulator may consume a relatively large amount of power during operation. This power consumption may be problematic in several regards. For example, such power consumption reduces an amount of power transmitted through the regulator to the microprocessor. Further, any heat generated by the regulator's consumption of power must be dissipated and subtracts from a thermal budget allotted to the microprocessor. Accordingly, improved power regulators suitable for regulating high current, which dissipate relatively little power are desired.

SUMMARY OF THE INVENTION

The present invention provides improved apparatus and techniques for regulating power to a microelectronic device. More particularly, the invention provides improved devices and methods suitable for supplying electronic devices with relatively high, regulated current, with relatively little power loss.

The way in which the present invention addresses the deficiencies of now-known regulators and power supply systems is discussed in greater detail below. However, in general, the present invention provides an additional voltage source to operate a pass transistor of a linear regulator close to its saturation point. This allows the regulator to run more efficiently and thus consume less power during operation.

In accordance with one exemplary embodiment of the present invention, a regulator includes an error amplifier, a transistor, a compensation network, a reference voltage source, a supplemental voltage source, an input voltage terminal, an output voltage terminal, and a Schottky clamp.

BRIEF DESCRIPTION OF THE DRAWING

The drawing FIGURE illustrates a power regulation system in accordance with an exemplary embodiment of the present invention.

DETAILED DESCRIPTION OF EXEMPLARY EMBODIMENTS

The present invention generally relates to microelectronic power regulators. More particularly, the invention relates to regulators suitable for providing high current, high speed power to microelectronic devices and to electronic systems including the regulators. Although the present invention may be used to provide power to a variety of microelectronic devices, the invention is conveniently described below in connection with providing power to microprocessors.

The drawing FIGURE schematically illustrates a power regulation circuit 100 in accordance with an exemplary embodiment of the present invention. Exemplary circuit 100 includes an error amplifier 110, a transistor 120, a compensation network 130 coupled to an emitter region of the transistor, a Schottky clamp 140, a reference voltage source 150, a supplemental voltage source 160, an input voltage terminal 170, and an output voltage terminal 180.

In general, circuit 100 is configured to provide high current output (e.g., 100 amps or more), while consuming relatively little power. More particularly, circuit 100 is designed such that transistor 120 operates near its saturation point to reduce resistance through transistor 120 and consequently reduce a base-emitter voltage drop ($V_{BE}$) across the transistor.

In operation a relatively high voltage (e.g., from supplemental voltage source 160) is applied to an input or base region of transistor 120 to cause transistor 120 to operate near its saturation point. In accordance with one embodiment of the invention, the relatively high voltage is applied to amplifier 110. Supplemental voltage source 160 is suitably configured to supply transistor 120 with any voltage greater than voltage applied at input source 170. For example, source 160 may supply error amp 110 with a voltage of 3.3 volts, where input 170 voltage is about 1.1 volt and voltage at output 180 is about 1.0 volt.

Schottky clamp 140 is suitably configured to prevent forward biasing of transistor 120. Thus, a voltage higher than voltage at input 170 may be applied to a base region of transistor 120 without forward biasing transistor 120. Clamp 140 is suitably coupled to a base region of transistor 120, input voltage 170, and a collector region of transistor 120.

Transistor 120 is preferably an N-P-N transistor. In addition, transistor 120 is preferably formed on a semiconductive substrate having relatively high conductor mobility—for example, a compound semiconductor material such as silicon germanium, gallium arsenide, or the like.

Although the present invention is set forth herein in the context of the appended drawing figure, it should be appreciated that the invention is not limited to the specific form shown. For example, while the invention is conveniently described above in connection with an N-P-N transistor, other forms of transistors may suitably be used in connection with the present invention. Various other modifications, variations, and enhancements in the design and arrangement of the method and apparatus set forth herein may be made without departing from the spirit and scope of the present invention as set forth in the appended claims.

I claim:

1. A microelectronic device for producing regulated current comprising:

a transistor having a base region, a collector region, and an emitter region;

a voltage reference source coupled to said base region of said transistor;

a supplemental voltage source coupled to said base region of said transistor; and a Schottky clamp coupled to said base and said collector of said transistor.

2. The microelectronic device for producing regulated current of claim 1, further comprising a voltage input terminal coupled to said Schottky clamp.

3. The microelectronic device for producing regulated current of claim 1, further comprising an error amplifier coupled to said base region of said transistor.

4. The microelectronic device for producing regulated current of claim 3, wherein said error amplifier comprises an output region and said error amplifier output region is coupled to said supplemental voltage source.

5. The microelectronic device for producing regulated current of claim 3, further comprising a compensation network coupled to said emitter region of said transistor.

6. The microelectronic device for producing regulated current of claim 5, wherein said compensation network is further coupled to an input of said error amplifier.

7. The microelectronic device for producing regulated current of claim 1, wherein said supplemental voltage source is configured to cause said transistor to operate near a saturation of said transistor.

8. The microelectronic device for producing regulated current of claim 1, wherein said transistor comprises an N-P-N type transistor.

9. The microelectronic device for producing regulated current of claim 1, wherein said device comprises compound semiconductor material.

10. The microelectronic device for producing regulated current of claim 9, wherein said compound semiconductor material is SiGe.

11. A microelectronic circuit comprising:

a transistor having a base region, a collector region, and an emitter region;

an input voltage source coupled to said base region and said collector region of said transistor;

a supplemental voltage source coupled to said base region of said transistor; and an error amplifier coupled to said base region of said transistor.

12. The microelectronic circuit of claim 11, further comprising a supplemental voltage source coupled to said error amplifier.

13. The microelectronic circuit of claim 12, wherein said supplemental voltage source is configured to cause said transistor to operate near a saturation of said transistor.

14. The microelectronic circuit of claim 12, wherein said supplemental voltage source is about 3.3 volts.

15. The microelectronic circuit of claim 11, wherein said circuit comprises a compound semiconductor.

16. The microelectronic circuit of claim 15, wherein said compound semiconductor is SiGe.

17. The microelectronic circuit of claim 11, further comprising a compensation network coupled to said emitter region of said transistor and an input region of said error amplifier.

* * * * *